United States Patent [19]

Hauber

[11] 4,068,408

[45] Jan. 17, 1978

[54] VENT OPERATOR

[75] Inventor: Peter Fritz Hauber, Burbank, Calif.

[73] Assignee: Reflectolite Products, Inc., Sun Valley, Calif.

[21] Appl. No.: 664,682

[22] Filed: Mar. 8, 1976

[51] Int. Cl.[2] ..... E05F 11/00

[52] U.S. Cl. ..... 49/324; 49/354

[58] Field of Search ..... 49/324, 325, 342, 343, 49/345, 346, 354, 341

[56] References Cited

U.S. PATENT DOCUMENTS

| | | | |
|---|---|---|---|
| 2,022,036 | 11/1935 | Haberstump | 49/346 X |
| 2,635,485 | 4/1953 | Gravenstine et al. | 49/342 X |
| 2,674,452 | 4/1954 | Hummert | 49/324 |
| 2,699,232 | 1/1955 | Singleton | 49/342 |
| 2,774,591 | 12/1956 | Jewett | 49/324 |
| 2,777,687 | 1/1957 | Jewett et al. | 49/342 |
| 2,801,845 | 8/1957 | Rodaway | 49/342 |
| 3,846,938 | 11/1974 | Kelly | 49/342 |

*Primary Examiner*—Philip C. Kannan
*Attorney, Agent, or Firm*—John E. Wagner

[57] ABSTRACT

A vent operator assembly employing a pair of operator arms which simultaneously control the position of an edge opening vent for recreational vehicles and the like. An operator body is secured to the inner side of the recreational vehicle adjacent to the vent opening therein. The body mounts a worm gear extending between a wall of the body and a cup recess in a bridge extending across a sector shaped recess in the body. A pair of operator arms, each including integral gears are journaled in the body from within the sector recess for simultaneous rotation in opposite arcs. The operator arms are relatively rigid except for the outer 16% which is a flexure spring element. Each spring element mounts a roller which engages a track in the edge of the vent cover opposite its hinged side. Upon rotation of a knob connected to the worm gear, the operator arms move simultaneously in the opposite direction to either open or close the vent cover. In the process, the flexure portion of the operator arms is distorted and applies a spring bias against the track of the vent cover providing rigid support thereof and vibration absorbtion.

1 Claim, 10 Drawing Figures

FIG. 3
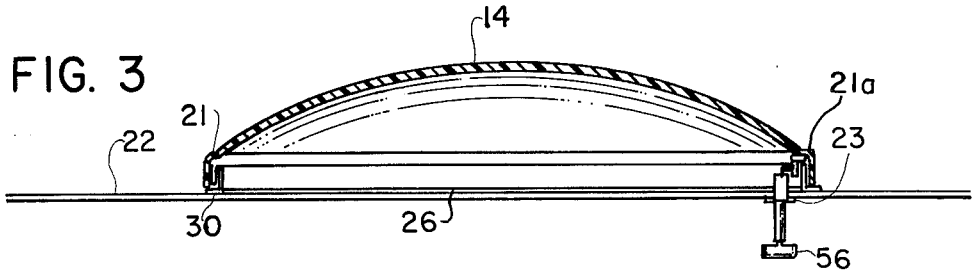
FIG. 4
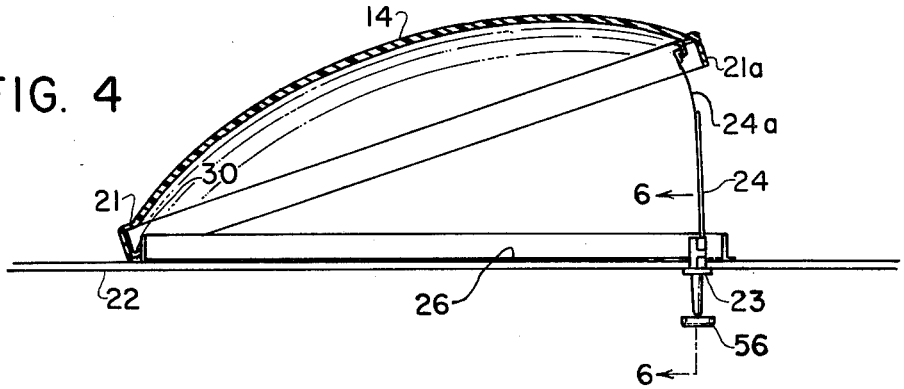
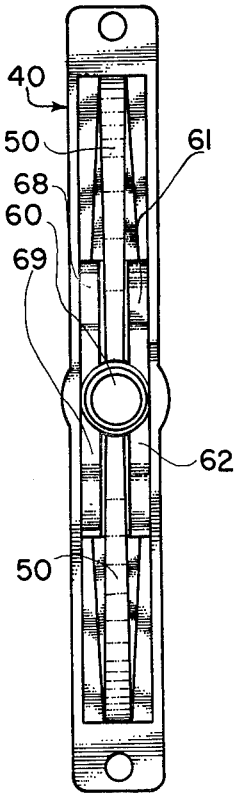
FIG. 10
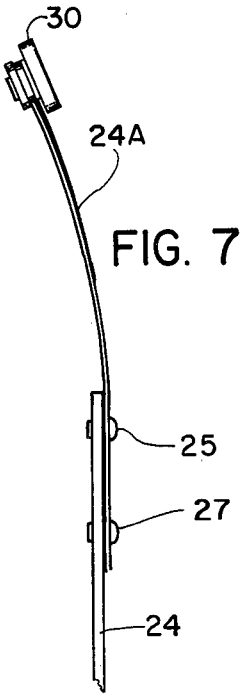
FIG. 7
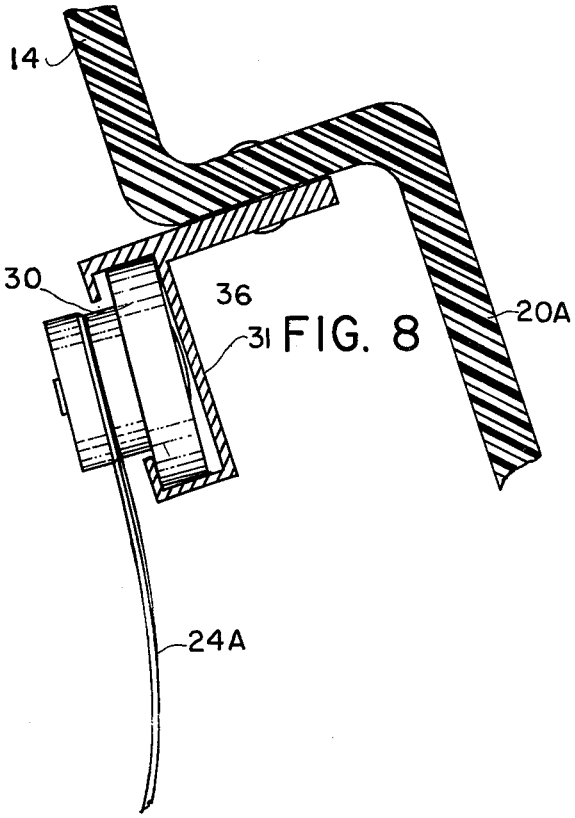
FIG. 8

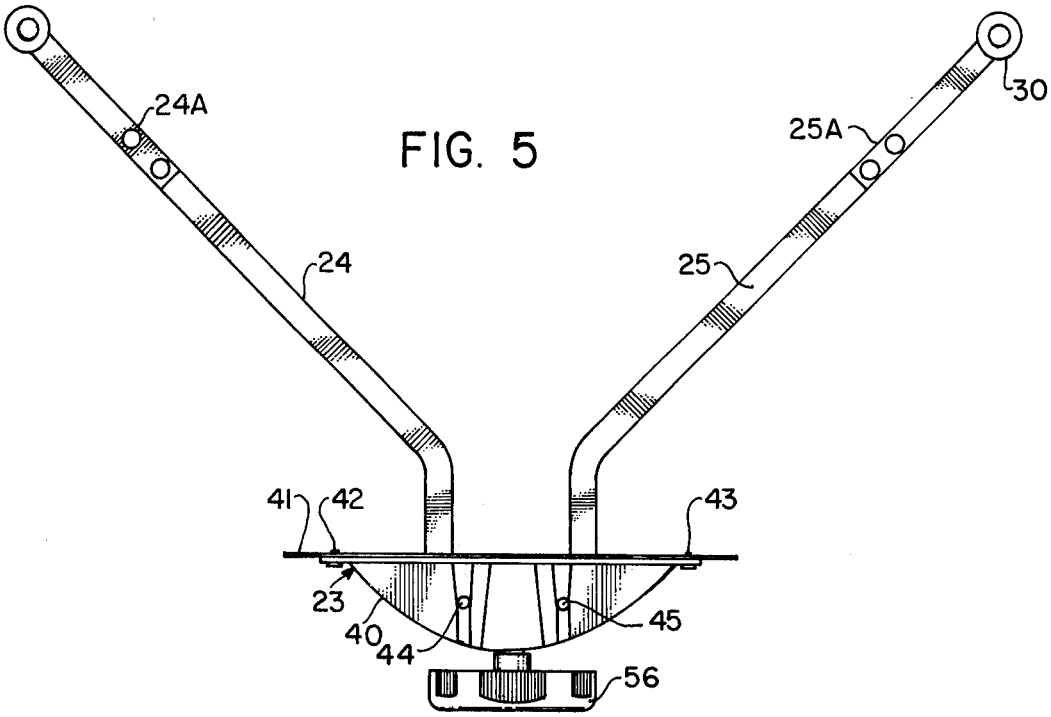
FIG. 5
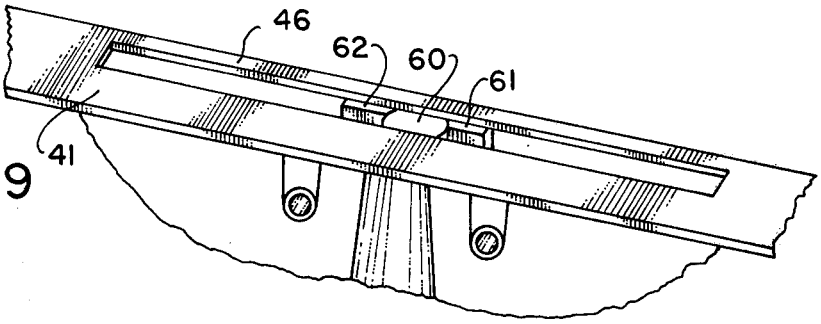
FIG. 9
FIG. 6
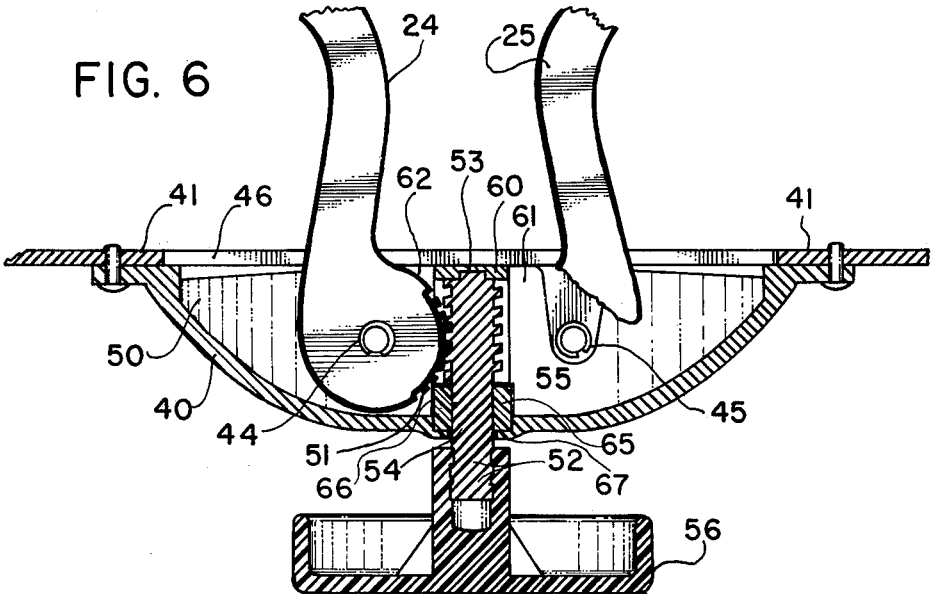

VENT OPERATOR

BACKGROUND OF THE INVENTION

In recreational vehicles, it has been common to employ vents in the roof which are hinged at one side and are elevated by means of an arm connected to the vent cover and to the structure of the recreational vehicle. Typically a single operator arm includes an integral sector gear which mates with a worm gear operated by a hand knob. An example of such an operator is shown in U.S. Pat. No. 3,846,938. In that patent and in the references cited therein, a single operator arm is employed.

In larger size vents, it is essential that greater rigidity is required. This has been accomplished employing double arm operators which trasverse arcuate paths in a plane vertical or normal to the plane of the surface in which the vent is mounted in passing through the open edge of the edge hinge of the vent cover. Both operators commonly have a single worm gear which drives a pair of integral sector gears.

I have discovered that whenever larger sizes of vents, namely those having an area in the order of three square feet or larger are to be used not only must double operator arm arrangement be employed, but provision must be made to combat vibration of the vent cover under heavy wind loading. Further, provision must be made for effective transfer of the substantial wind load to the body of the recreational vehicle.

BRIEF DESCRIPTION OF THE INVENTION

Given the foregoing needs, I have developed an improved vent operator of the dual arm type. It employs a pair of operator arms each having at their inner ends a sector gear which mates with a common helical gear secured within the operator body. The operator body includes a generally sector shaped recess between a pair of side walls with a single bridge member extending over the top portion to close the central region of the recess. The worm gear operates into the central bridge and through an aperture in the operator body. An overlying plate transfers load from the operator body and the bridge to the recreational vehicle roof of other surface.

The operator arms are of relatively rigid material such as stamped steel throughout approximately 75% of its length and thereafter terminate in spring steel extensions, each bearing a load transfer device, such as a roller. The spring extension of the arm accomodates the arcuate path of the vent cover and provides constant bias against a track in the vent and thereby holds the vent cover securely but absorbing any vibration.

BRIEF DESCRIPTION OF THE DRAWINGS

FIG. 3 is a vertical sectional view through the ventilator of FIG. 1 along lines 3—3 of FIG. 1;

FIG. 4 is a vertical sectional view of the ventilator assembly of this invention taken along line 4—4 of FIG. 2;

FIG. 5 is a side elevational view of the operator of the vent assembly of this invention;

FIG. 6 is a fragmentary vertical transverse section view through the operator taken along line 6—6 of FIG. 4;

FIG. 7 is an enlarged fragmentary view of the operator arm of FIGS. 4 and 5;

FIG. 8 is a greater enlarged fragmentary view of the end of the operator assembly of FIGS. 4 and 7;

FIG. 9 is a fragmentary perspective view of the operator body; and

FIG. 10 is a top view of the body of the closure operator of this invention.

DETAILED DESCRIPTION OF THE INVENTION

Figure 1:
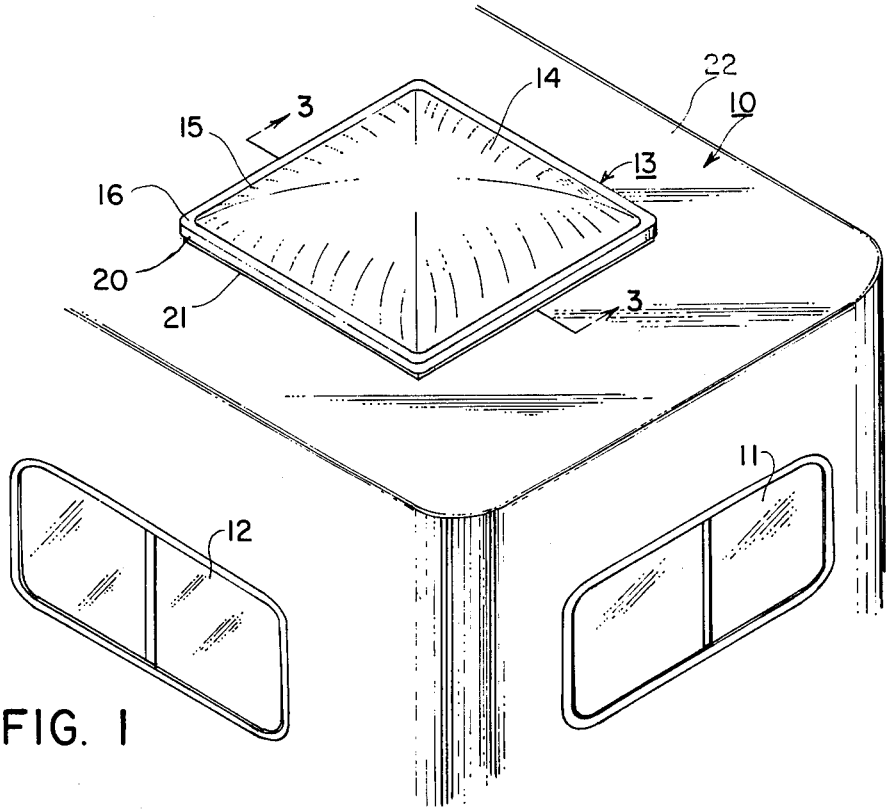
FIG. 1 is a perspective view of a recreational vehicle incorporating this invention in a roof ventilator with the ventilator closed.

As indicated above, this invention is directed principally to operators for roof vents for recreational vehicles and the like in which the vent is of substantial size, for example three square feet or greater. In FIG. 1, a recreational vehicle 10 is shown having a number of conventional window openings 11 and 12 and a roof vent generally designated 13, having a cover 14 which preferably is of transparent or translucent plastic material. The vent cover 14 of FIG. 1 shows a slightly domed portion 15 and an edge portion 16 including depending skirt 20 which encloses an upstanding lip 21 of the vehicle top 22. When in the down or closed position as shown in FIG. 1, the vent assembly 13 seals the recreational vehicle 10 from the ingress of either moisture or dust while allowing subdued lighting of the interior in the case where the cover 14 is translucent.

Figure 2:
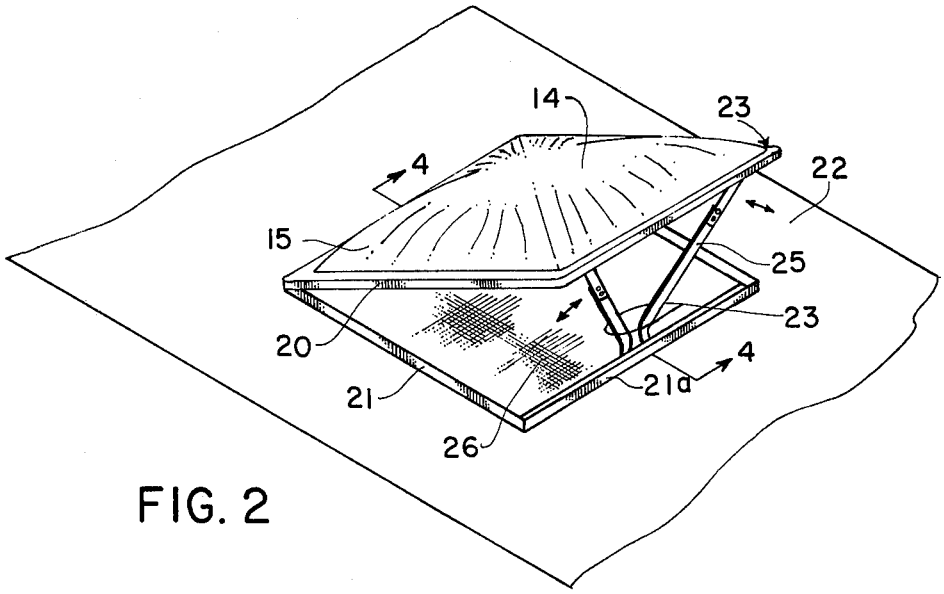
FIG. 2 is a fragmentary perspective view of the recreational view of FIG. 1 with the ventilator open.

Vents of the type shown in FIG. 1 are typically hinged at one side by a hinge unshown in the drawing to allow the vent to be opened. The open vent appears in FIG. 2. The operation of the unseen hinge is apparent in FIG. 2 and it may be better seen in FIGS. 3 and 4 described below. In FIG. 2 the operator assembly 23 including a pair of operator arms 24 and 25 is visible in the region between the camper top 22 and the corner 14. The ends of the operator arms 24 and 25 which are unseen in FIG. 2 engage the cover 14 in a manner described below. Suffice it to say the operator arms, when operated, are rotated in the direction of the arrows in FIG. 2 when a common operator knob 56 appearing in the remaining figure of this application is turned in one direction or the other. When the knob 56 is rotated clockwise, the operator arms 24 and 25 each rotate towards each other and in so doing, raise the vent cover 14 as shown in FIG. 4. Rotating knob 56 in the opposite direction rotates arms 24 and 25 away from each other and lowers the vent cover 14 until the arms 24 and 25 are nested along the inner side of lip 21*a*, and the vent cover 14 is fully closed as shown in FIGS. 1 and 3. Typically, the opening in the camper or other recreational vehicle roof 22 exposed by the lifting of the vent cover 14 is closed to insects by a screen 26. The opening and closing of the vent cover 14 is accomplished without interference with the screen 26.

Now referring specifically to FIGS. 3 and 4, the physical relationship of the vent cover 14 and its operator 23 is more apparent. In these figure, for the first time hinge 30 may be seen as secured to the vehicle roof 22 and inside skirt 21 of the vent cover 14. As noted in FIG. 3, the operator arms 24 and 25 assume a flat position within the cover 14 when closed. This is all in accordance with the known practice in the vent art.

Where large vents are required to be open as in the case of this invention, the double arm operator as opposed to a single arm is required. I have found, however, that because of the relatively high windloading on a large area vent when in the open position and wind gusts are present, there is a need not to hold the vent rigidly, but to absorb vibration to cut down the danger of fracturing the vent 14 and unwanted noise within the recreational vehicle. This is accomplished because of the feature which is shown in FIG. 4. In this case the vent operator arm 24 appears to be relatively rigid over its major length and thereafter is distorted in an end region 24*a*. The distortion described is best illustrated in FIG. 7 where the operator arm 24 is secured at its outer end by, for example, a pair of rivets 25 and 27. A spring steel extension 24A journals a roller 30. Note in FIG. 7 that the extension 24A is distorted in two planes, namely bent out of the plane of operator arm 24, and twisted as well. The extent of distortion of the arm 24 is a function of the elevation of the vent cover 14. This is due to the arcuate travel of the lip 21*a* while the operator arm 24 is maintained in the vertical plane.

The securement of the operator arm extension 24*a* and roller 30 to the vent cover 14 within the skirt 20*a* is accomplished by the use of a C channel shaped track 31 which may be open ended to allow the assembly of the roller 30 within the access opening. The track 31 is secured by rivets 32 or other means to the vent cover 14. This is all illustrated in FIG. 8 where it is also apparent that the roller 30 is located eccentrically within the track 30. This roller is perferably of a low friction material such as the polyamide resins sold by E. I. duPont deNemour's Co. of Wilmington, Delaware, under the trademarks NYLON or DELRIN, or other similar materials. The roller may be of metal but a distortable contact between the roller 30 and the track 31 is desirable. As illustrated in FIG. 8, the vent 14, track 31 and roller 30 are relatively rigidly positioned when the vent cover 14 is elevated due to the mechanical bias supplied by the spring extension 24A of the arm 24.

The following dimensions and materials have been found to be desirable for the operator arms and arm extensions:

| | |
|---|---|
| Arms 24 & 25 | A.S.T.M. type 1018<br>hot rolled steel<br>3/8" × 10 ga.<br>80–88% of overall length |
| Extensions 24a & 25a | A.S.T.M. 1095 spring steel<br>5/16 × 0.025"<br>12–20% of overall length |

The foregoing is operable with a vent having an openable transverse dimension of approximately 2.5 feet square and a maximum extent of opening of approximately 10 inches.

In the embodiment shown, the foregoing vibration damping feature is fully accomplished. Additionally, the operator of this invention incorporates another feature which is not as clearly apparent and which adds significant strength whereby the danger of jamming due to excess load on the operator arms is eliminated. This feature is illustrated particularly in FIGS. 5, 6, and 9. The operator assembly shown there and designated as generally 23, includes a cast body 40 normally secured to an overhanging base plate 41 as by rivets 42 and 43 and mounts the operator arms 24 and 25 by pins 44 and 45 which preferably are split pins pressed fit into mating openings in the side wall of the body 40. As is apparent in FIG. 6, body 40 includes an elongated upper opening 46 through which the arms 24 and 25 extend. The body 40 includes a generally sector shaped recess 50 in which the operator arms 24 and 25 terminate. Each of these arms 23 and 24 include stamped or machined integral gear teeth 51 mating with a helical screw 52 which is journaled into a dead end recess 53 at one end and in an aperture 54 at the inner end of the body 40. The helical screw member 52 includes serrations 55 at the outer end which mate with plastic or similar handle 56.

The cavity 53 is formed in an integral web 60 extending between the side walls of the body member 40 and further reinforced by buttress portions 61 and 62 on the remote side as shown in FIG. 6 and their counterparts on the near sides of the housing 40. The buttresses 61 and 62 further cooperate to define a channel like receptical for respective pins 45 and 44 which extend transversely through the body 40. Therefore with a minimum of total metal present in the body 40, the axis of rotation of the operator arms 24 and 25, namely the pins 44 and 45 are reinforced by the buttresses 61 and 62. Also the operator screw 52 which transfers load from the arms 24 and 25 to the body bears directly into the bridge 60. This bridge 60 further engages the plate 41 which is in direct contact with the recreational vehicle to which the operator assembly is attached. It is therefore able to transfer the forces directly to the body of the vehicle.

The portion of the operator screw 52 beyond the screw threads is reduced in diameter and journaled in a bearing, for example, a Nylon bushing 65 held in a cup recess 66 by a rolled lip 67 of the body 40. As is apparent in FIG. 6 the screw 52 is captured between the bridge 60 and the biasing 65 for effective load transfer from the screw 52 to the body 40.

FIG. 10 additionally illustrates the design of the body 40 whereby significant strength improvement is achieved over prior vent operators. Note that bridge 60 extends across the crescent shaped recess 50 and thereby strengthens the body. Further, the bridge 60 includes the dead end recess 53 of FIG. 6 into which the screw operator 52 is journaled. The load transfered from the operator arms 24 and 25 of FIGS. 5 and 6 to the screw operator 52 is directly transfered to the bridge 60 of substantial thickness. Bridge 60 extends between the side walls of body 40 at the buttresses 61, 62, 68 and 69.

What is claimed is:

1. A closure assembly for recreational vehicles having an opening in the surface thereof comprising;

a closure cover;

means hinging said closure cover from one side thereof to overlie said opening;

an operator assembly including a unitary body portion affixed to said recreational vehicle at the side of the opening therein opposite the hinged side of the closure cover;

an operator shaft including a worm gear portion mounted for rotational movement within said operator assembly body portion;

operator arms engaging said operator shaft for arcuate movement thereby and engaging said cover to open and close said cover;

said body further defining a recess for receiving operator arms including access from said recess to opposite sides of said worm gear portion of said operator shaft;

said body portion further including an integral bridge portion extending across said recess and defining therein a bearing recess for said operator shaft and the outer surface of said bridge portion being a mounting surface of said body whereby loads from said closure cover are transferred via said operator arms to said shaft and to said operator body and the recreational vehicle through said bridge portion.

* * * * *